US011773569B2

(12) United States Patent
Lee et al.

(10) Patent No.: US 11,773,569 B2
(45) Date of Patent: Oct. 3, 2023

(54) POWER MODE RECOMMENDATION SYSTEM FOR CONSTRUCTION MACHINE

(71) Applicant: Volvo Construction Equipment AB, Eskilstuna (SE)

(72) Inventors: Sanghee Lee, Gyeongsangnam-do (KR); Chunhan Lee, Gyeongsangnam-do (KR); Okjin Suk, Gyeongsangnam-do (KR); Miok Kim, Gyeongsangnam-do (KR); Sanggyun Shin, Gyeongsangnam-do (KR)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 472 days.

(21) Appl. No.: 16/978,254

(22) PCT Filed: Mar. 9, 2018

(86) PCT No.: PCT/KR2018/002839

§ 371 (c)(1),
(2) Date: Sep. 4, 2020

(87) PCT Pub. No.: WO2019/172473

PCT Pub. Date: Sep. 12, 2019

(65) Prior Publication Data

US 2021/0010238 A1 Jan. 14, 2021

(51) Int. Cl.
*E02F 9/22* (2006.01)
*E02F 9/26* (2006.01)

(52) U.S. Cl.
CPC . *E02F 9/22* (2013.01); *E02F 9/26* (2013.01)

(58) Field of Classification Search
CPC ... E02F 9/22; E02F 9/26; E02F 9/2235; E02F 9/2246; E02F 9/2296; E02F 9/267
See application file for complete search history.

(56) References Cited

U.S. PATENT DOCUMENTS

2004/0256165 A1* 12/2004 Tomita ..... B60W 30/19 903/910
2012/0330500 A1 12/2012 Kamada et al.
2014/0336916 A1 11/2014 Yun et al.

FOREIGN PATENT DOCUMENTS

JP 2015140800 A 8/2015
WO 2013168312 A1 11/2013
(Continued)

OTHER PUBLICATIONS

International Search Report and Written Opinion of the International Searching Authority, PCT/KR2018/002839, dated Dec. 10, 2018, 10 pages.

*Primary Examiner* — Tyler J Lee
*Assistant Examiner* — Yufeng Zhang
(74) *Attorney, Agent, or Firm* — Sage Patent Group

(57) ABSTRACT

A power mode recommendation system for a construction machine including a hydraulic system driven by working fluid supplied by a hydraulic pump. A controller configured to analyze engine torque, flow rates of working fluid in use, amounts of fuel consumption of the plurality of power modes and to recommend a power mode indicating lowest fuel consumption, from among the plurality of power modes, using the analysis. A human-machine interface (HMI) device displays the power mode recommended by the controller to an operator. The system recommends an efficiency power mode to an operator by analyzing not only the amount of fuel consumed by the construction machine, but also flow rates of working fluid in use and operating speeds.

11 Claims, 5 Drawing Sheets

(56) References Cited

FOREIGN PATENT DOCUMENTS

| | | | |
|---|---|---|---|
| WO | 2016043364 | A1 | 3/2016 |
| WO | WO2016043364 | A1 * | 3/2016 |

* cited by examiner

[Fig. 1]
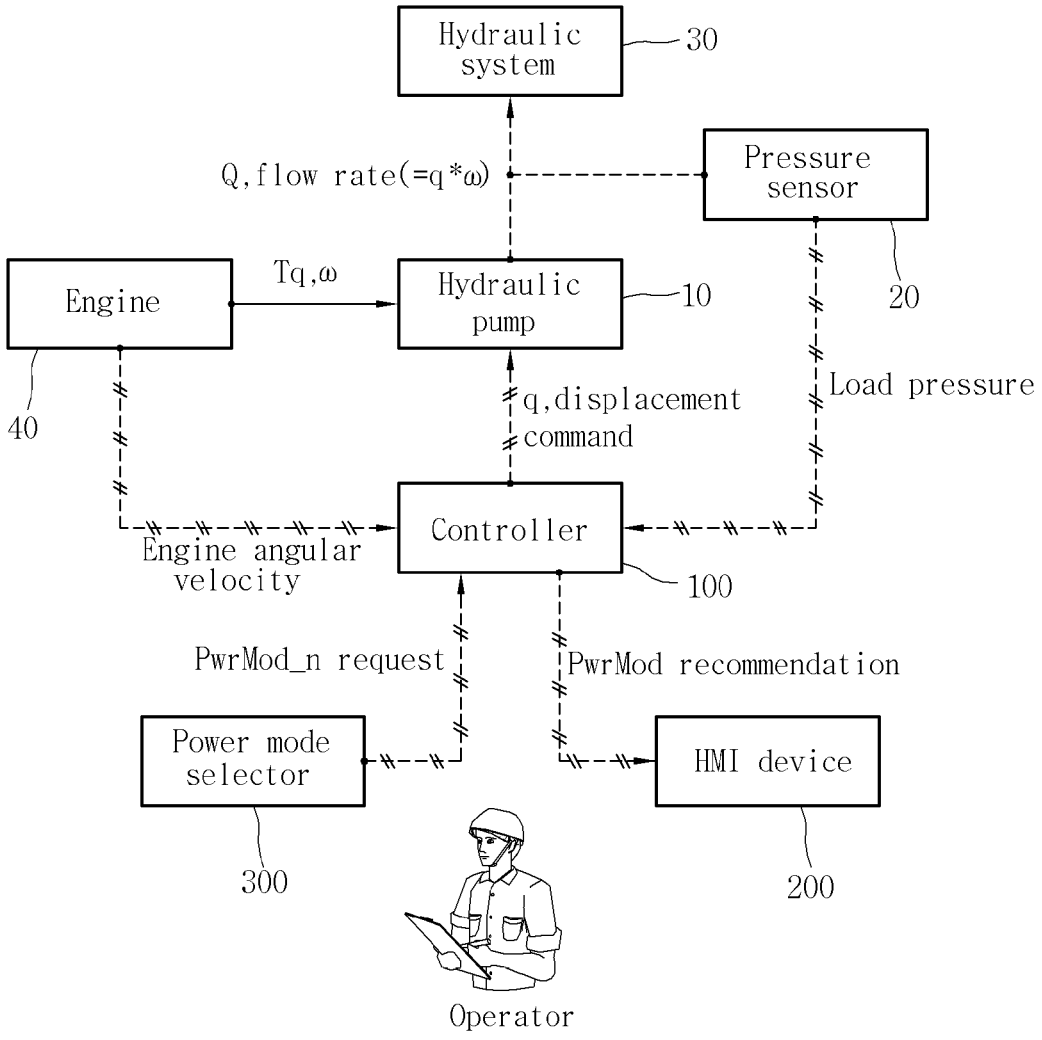

[Fig. 2]
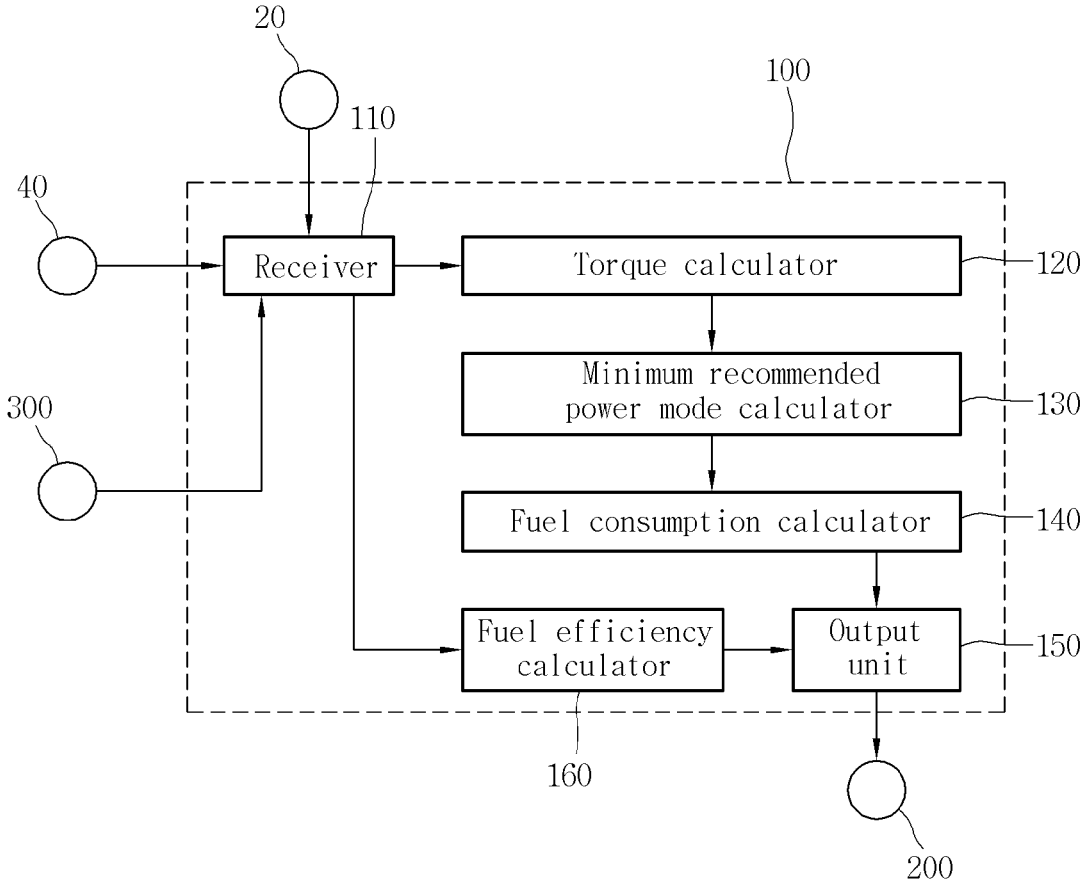
[Fig. 3]
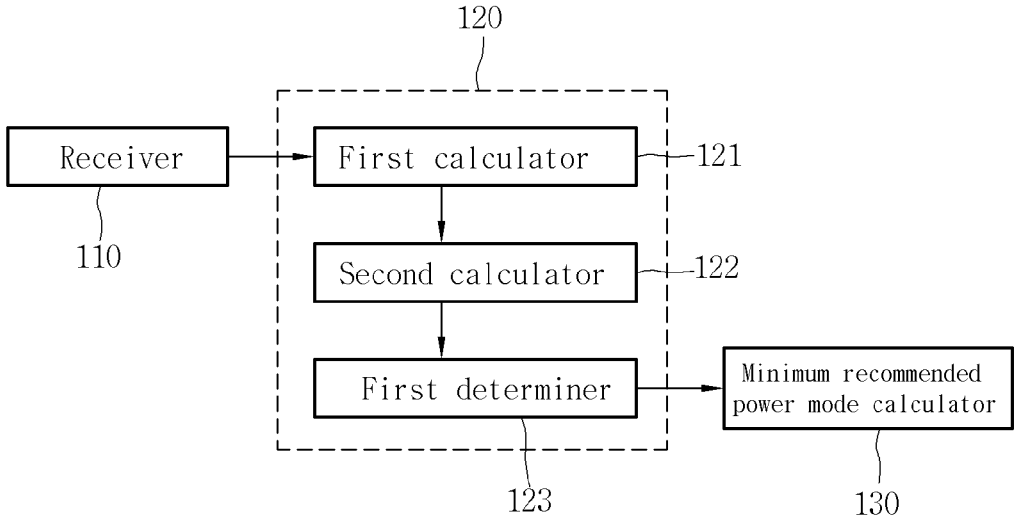

[Fig. 4]
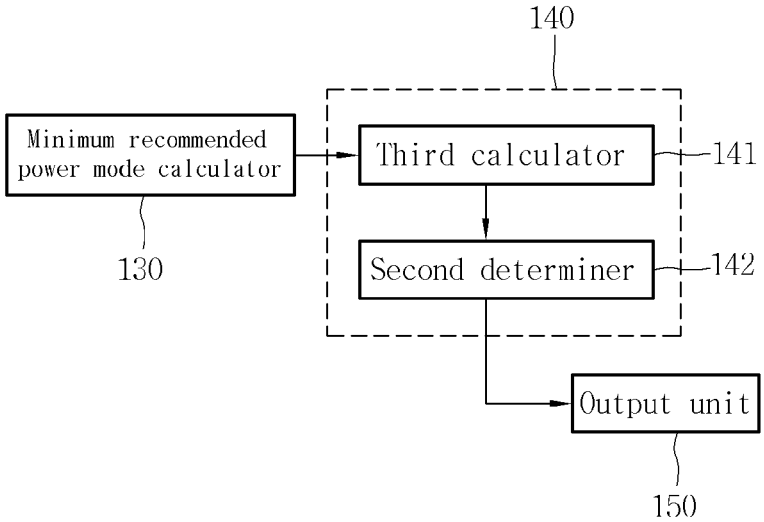
[Fig. 5]
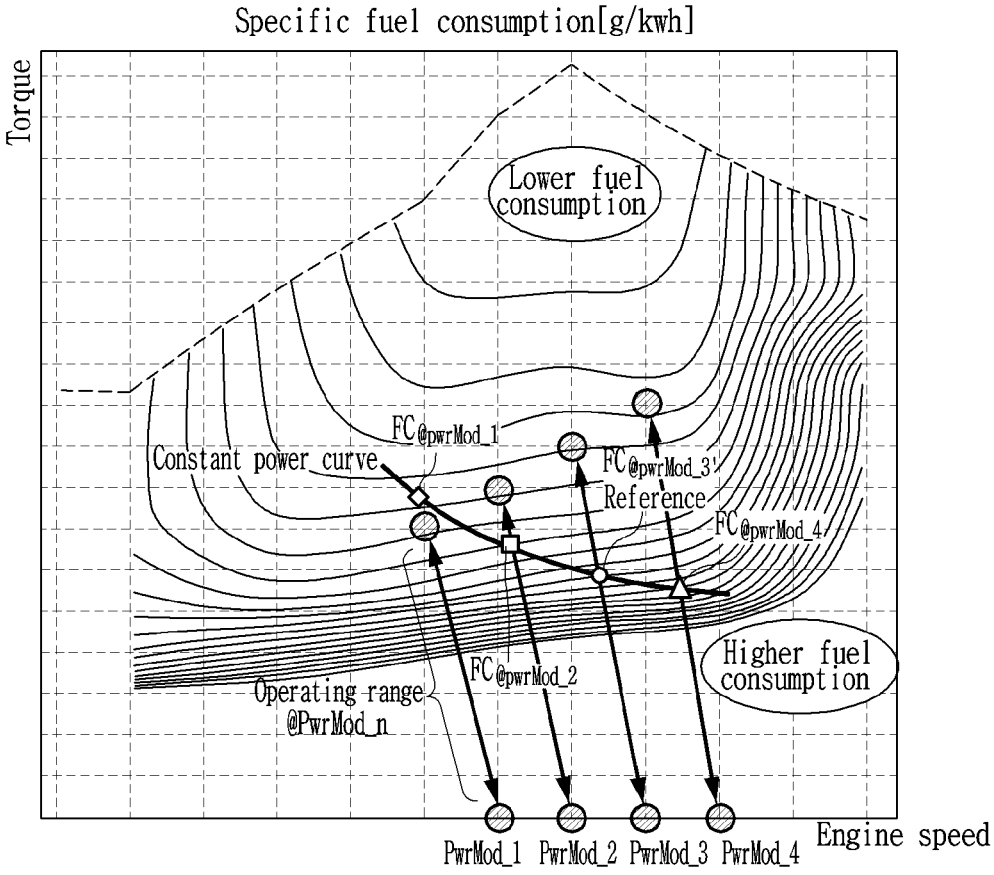

[Fig. 6]
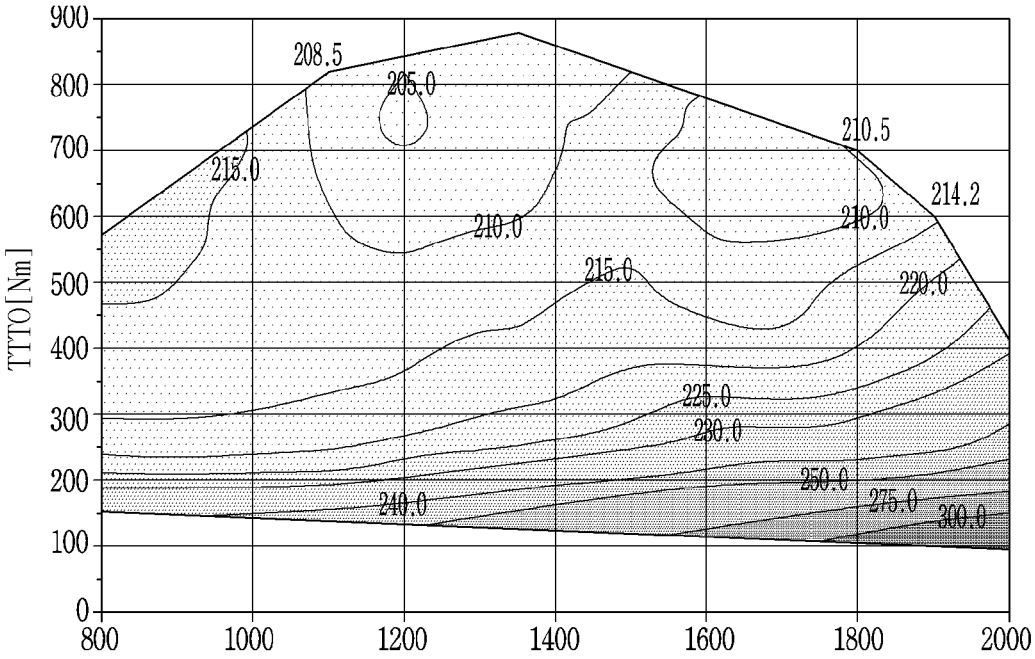
[Fig. 7]
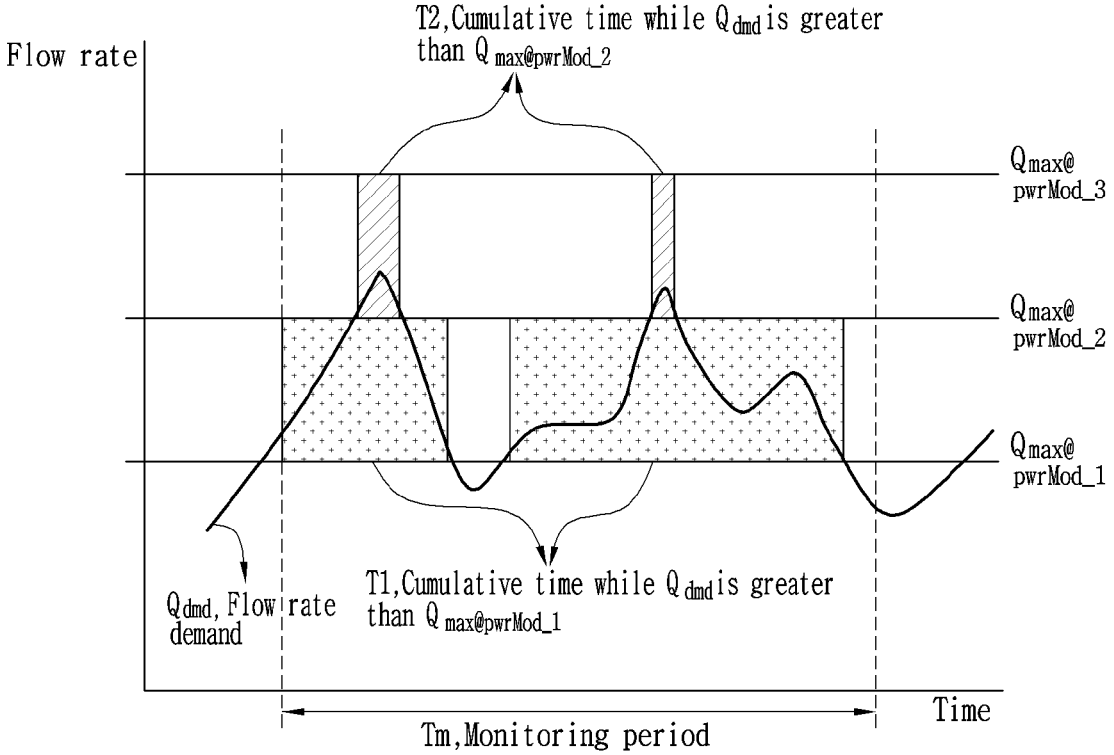

[Fig. 8]
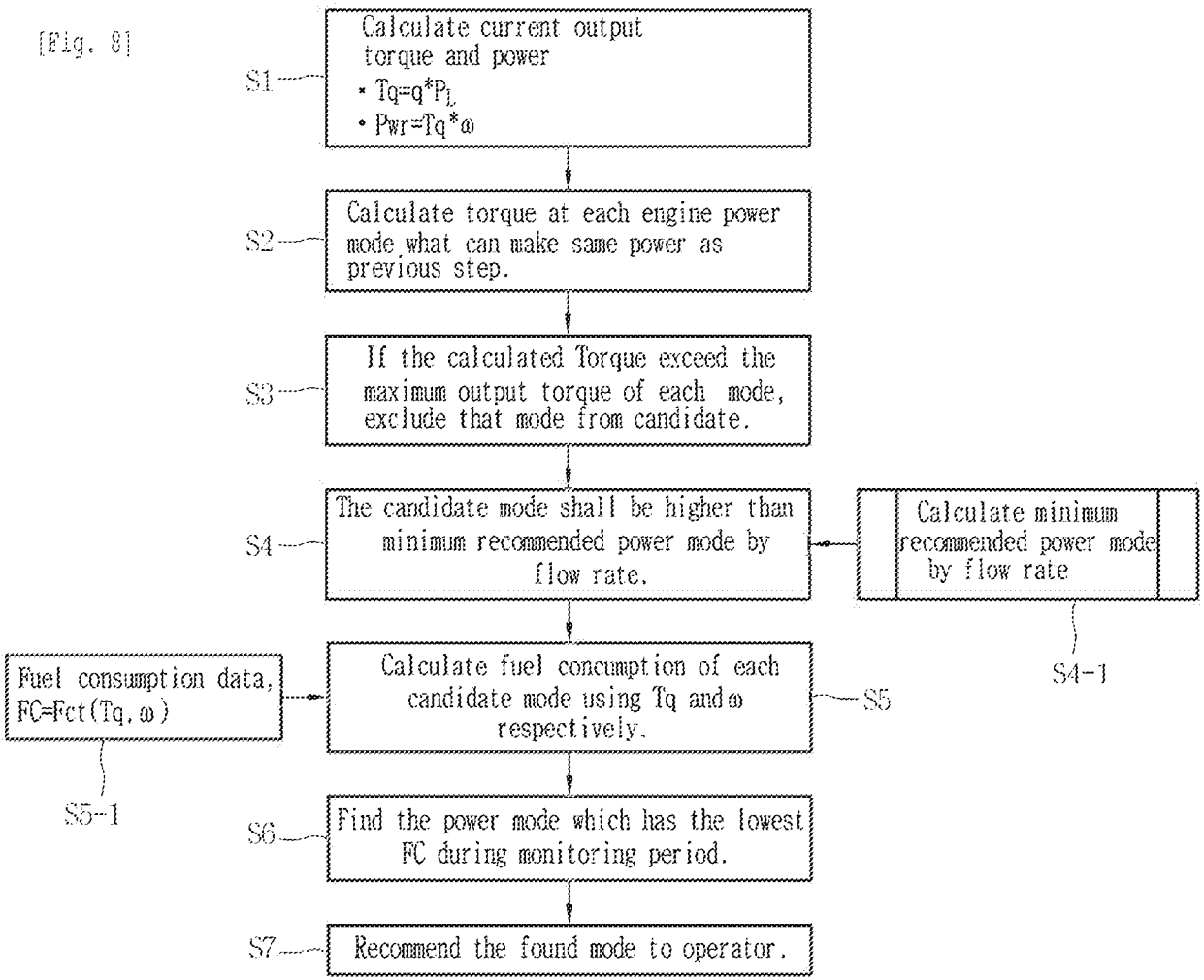

POWER MODE RECOMMENDATION SYSTEM FOR CONSTRUCTION MACHINE

CROSS REFERENCE TO RELATED APPLICATIONS

This application is a 35 U.S.C. § 371 national stage application of PCT International Application No. PCT/KR2018/002839 filed on Mar. 9, 2018, the disclosure and content of which is incorporated by reference herein in its entirety.

TECHNICAL FIELD

The present disclosure relates to a power mode recommendation system for a construction machine. More particularly, the present disclosure relates to a power mode recommendation system for a construction machine that can recommend an efficient power mode to an operator by analyzing not only the amount of fuel consumed by the construction machine, but also flow rates of working fluid in use and operating speeds.

BACKGROUND ART

When working with a construction machine, for example, an excavator, some operators may set a high-power mode, even when performing light-load operations. However, such a habit may lead to fuel wastage.

In the related art, a method of recommending an appropriate power mode to an operator has been proposed in order to overcome the problem of fuel wastage. Such a power mode recommendation method is designed to recommend a power mode indicating a lowest amount of fuel consumption on a single output curve of an engine fuel map.

However, the power mode recommendation method of the related art may have limited ability, since the operating speeds of excavators are not considered. For example, when engine angular velocity decreases and output torque increases under the same power conditions, fuel consumption tends to decrease. When a system controlling this power mode recommendation method only recommends a power mode consuming a lowest amount of fuel, engine angular velocity may decrease. Accordingly, an operator may not be satisfied by the operating speed under light-load conditions, since the maximum operating speed is determined by engine angular velocity under light-load conditions.

DISCLOSURE OF INVENTION

Technical Problem

Various aspects of the present disclosure provide a power mode recommendation system for a construction machine that can recommend an efficiency power mode to an operator by analyzing not only the amount of fuel consumed by the construction machine, but also flow rates of working fluid in use and operating speeds.

Solution to Problem

According to an aspect, provided is a power mode recommendation system for recommending a power mode from among a plurality of power modes for operation of an engine of a construction machine, the construction machine including a hydraulic system driven by working fluid supplied by a hydraulic pump, the hydraulic system including a pressure sensor for sensing pressure of working fluid. The power mode recommendation system may include: a controller configured to analyze engine torque, flow rates of working fluid in use, amounts of fuel consumption of the plurality of power modes and to recommend a power mode indicating lowest fuel consumption, from among the plurality of power modes, using the analysis; and a human-machine interface (HMI) device displaying the power mode recommended by the controller to an operator.

The controller may include: a torque calculator configured to calculate torque amounts of the engine according to the plurality of power modes, and based on the calculated torque amounts, select first candidate power modes from among the plurality of power modes; a minimum recommended power mode calculator configured to calculate minimum recommended power modes according to flow rates of working fluid, and based on the calculated minimum recommended power modes, select second candidate power modes from among the first candidate power modes; and a fuel consumption calculator configured to calculate amounts of fuel consumption of the second candidate power modes.

The torque calculator may include: a first calculator configured to calculate output torque and power of the engine in a current state, based on flow rates of working fluid discharged by the hydraulic pump, angular velocity of the engine, and pressure of hydraulic fluid transferred by the pressure sensor; and a second calculator configured to calculate torque amounts, capable of generating the same power as the power calculated by the first calculator, according to the plurality of power modes.

The torque calculator may further include a first determiner. When the torque amount of a specific power mode among the plurality of power modes, calculated by the second calculator, is greater than a preset maximum torque amount of the specific power mode, the first determiner may exclude the specific power mode from among the first candidate power modes.

The minimum recommended power mode calculator may select power modes from among the first candidate power modes, having higher engine angular velocity than the minimum recommended power modes, as the second candidate power modes.

The fuel consumption calculator may include a third calculator calculating amounts of fuel consumption of the second candidate power modes using fuel consumption data including torque and angular velocity.

The fuel consumption calculator may further include a second determiner selecting one power mode from among the second candidate power modes, indicating lowest fuel consumption during a monitoring period, as a final recommendation power mode, based on the calculated amounts of fuel consumption of the second candidate power modes.

The controller may further include an output unit transferring the final recommendation power mode, selected by the second determiner, to the HMI device.

The controller may further include a fuel efficiency calculator calculating average fuel efficiencies of the plurality of power modes.

The fuel efficiency calculator may calculate average loads of the plurality of power modes and calculate average fuel efficiencies during a specific period using the calculated average loads.

The fuel efficiency calculator may calculate real-time fuel efficiencies of the plurality of power modes, and based on the real-time fuel efficiencies, determine the average fuel efficiencies of the plurality of power modes.

The power mode recommendation may further include a power mode selecting device connected to the controller, wherein the power mode selecting device is manipulated by the operator to select one power mode from among the plurality of power modes.

Advantageous Effects of Invention

As set forth above, the above-described power mode recommendation method according to the present disclosure can analyze not only the amount of fuel consumption of a construction machine, but also flow rates of working fluid in use and operating speeds, and based on the analysis, recommend an efficient power mode, in particular, an optimal power mode, to an operator as long as productivity is significantly reduced. This can consequently minimize fuel wastage while satisfying the operating speed of the construction machine.

According to the present disclosure, flow rates of working fluid are monitored, and even if there is a power mode, the fuel consumption of which is lower than the fuel consumption of the current power mode using a higher flow rate of working fluid, the power mode may not be recommended in consideration of the operating speed of the construction machine. Rather, another power mode indicating lower fuel consumption while maintaining the operating speed of the construction machine to a specific extent is recommended. It is thereby possible to satisfy both the amount of fuel consumption and the operating speed of the construction machine.

BRIEF DESCRIPTION OF DRAWINGS

FIG. 1 is a configuration view illustrating a power mode recommendation system for a construction machine according to an exemplary embodiment;

FIG. 2 is a configuration view illustrating the controller in the power mode recommendation system for a construction machine according to the exemplary embodiment;

FIG. 3 is a configuration view illustrating the torque calculator of the controller according to the exemplary embodiment;

FIG. 4 is a configuration view illustrating the engine consumption calculator of the controller according to the exemplary embodiment;

FIG. 5 is a fuel map of a construction machine illustrating a constant power curve;

FIG. 6 is a fuel map of a construction machine different from FIG. 5;

FIG. 7 is a graph illustrating the relationship between a maximum flow rate of working fluid and a monitoring period in each power mode; and FIG. 8 is a flowchart illustrating a power mode recommendation method of a power mode recommendation system for a construction machine according to an exemplary embodiment.

BEST MODE FOR CARRYING OUT THE INVENTION

Hereinafter, a power mode recommendation system for a construction machine according to exemplary embodiments will be described in detail with reference to the accompanying drawings.

Throughout this document, reference should be made to the drawings, in which the same reference numerals and symbols will be used to designate the same or like components. In the following description, detailed descriptions of known functions and components incorporated in the present disclosure will be omitted in the case in which the subject matter of the present disclosure is rendered unclear by the inclusion thereof.

Referring to FIG. 1, a power mode recommendation system according to an exemplary embodiment is a system for recommending a most efficient power mode, among a plurality of power modes for setting the output of an engine 40 in a construction machine, e.g. an excavator, to an operator, in which the recommended power mode is set to satisfy the operating speed of the excavator while minimizing fuel wastage.

The excavator includes a hydraulic system 30 for operating an actuator to move an attachment, such as a boom, an arm, and a bucket. The hydraulic system is driven by working fluid supplied by at least one hydraulic pump 10. A hydraulic line is disposed between the hydraulic pump 10 and the hydraulic system 30 to provide a path along which working fluid flows, and a pressure sensor 20 is disposed on the hydraulic line to sense the pressure of working fluid supplied to the hydraulic system 30 by the hydraulic pump 10.

The power mode recommendation system according to the exemplary embodiment analyzes not only the amount of fuel consumption, depending on the angular velocity of the engine, but also information regarding flow rates of working fluid provided by the pressure sensor 20 or the operating speed of the actuator, and based on the analysis, recommends an efficient or optimal power mode to the operator.

In this regard, the power mode recommendation system according to the exemplary embodiment includes a controller and a human-machine interface (HMI) device 200.

The controller 100 controls flow rates of working fluid discharged by the hydraulic pump 10. The controller 100 is connected to the engine 40 and the pressure sensor 20 to receive information regarding engine angular velocity and the pressure of working fluid therefrom. In addition, the controller 100 is connected to the HMI device 200 to transfer a selected power mode to the HMI device 200, so that the HMI device 200 displays the power mode to be recommended to the operator. Then, the operator can visually recognize the recommended power mode displayed on the HMI device 200 and determine whether or not to apply the recommended power mode.

As described above, the controller 100 according to the exemplary embodiment analyzes torque, a flow rate of working fluid in use, an amount of fuel consumption in each of the plurality of power modes to recommend an efficient power mode to the operator via the HMI device 200. Based on the analysis, the controller 100 recommends a power mode from among the plurality of power modes, indicating a lowest amount of fuel consumption without significantly decreasing the operating speed.

As apparent from the fuel map illustrated in FIG. 5, according to the exemplary embodiment, a first power mode PwrMod_1, a second power mode PwrMod_2, a third power mode PwrMod_3, and a fourth power mode PwrMod_4 are set as a group of candidate power modes, depending on engine angular velocity. However, the group of candidate power modes may be set to include more than four power modes, and the group of candidate power modes, i.e. the plurality of power modes, are not limited to the first power mode PwrMod_1, the second power mode PwrMod_2, the third power mode PwrMod_3, and the fourth power mode PwrMod_4.

According to the exemplary embodiment, a currently applied power mode, i.e. a power mode in use prior to power mode recommendation by the controller 100, is taken to be the third power mode PwrMod_3.

As illustrated in FIG. 2, the controller 100 may include a receiver 110, a torque calculator 120, a minimum recommended power mode calculator 130, a fuel consumption calculator 140, and an output unit 150 to recommend a single most efficient power mode from among the above-stated plurality of power modes.

The receiver 110 receives a pressure of working fluid sensed by the pressure sensor 20. The receiver 110 receives information regarding an engine angular velocity from the engine 40. In addition, the receiver 110 transfers information regarding the pressure of working fluid and engine angular velocity to the torque calculator 120.

The torque calculator 120 calculates the torque amounts of the engine 40 according to the plurality of power modes, and based on the calculated torque amounts, selects first candidate power modes from among the plurality of power modes. In this regard, as illustrated in FIG. 3, the torque calculator 120 may include a first calculator 121, a second calculator 122, and a first determiner 123.

The first calculator 121 calculates the output torque and power of the engine 40 in the current state, based on the flow rate of working fluid discharged by the hydraulic pump, the angular velocity of the engine 40, and the pressure of working fluid.

The second calculator 122 calculates torque amounts, capable of generating the same power as the power calculated by the first calculator 121, according to the plurality of power modes. FIG. 5 is a fuel map illustrating a constant power curve drawn by connecting the torque amounts of the plurality of power modes calculated by the second calculator 122. Referring to FIG. 5, power at a single point in a specific power mode can also be obtained at points in the remaining power modes. However, at the points indicating the same power, the plurality of power modes consume different amounts of fuel.

As illustrated in FIG. 5, although power at a specific point (designated with a circle) in the third power mode PwrMod_3 is equal to power at a specific point (designated with a triangle) in the fourth power mode PwrMod_4, the specific point in the third power mode PwrMod_3 indicates lower fuel consumption than the specific point in the fourth power mode PwrMod_4.

In contrast, although power at the specific point in the third power mode PwrMod_3 is equal to power at a specific point (designated with a square) in the second power mode PwrMod_2, the specific point in the third power mode PwrMod_3 indicates higher fuel consumption than the specific point in the second power mode PwrMod_2.

When the torque amount of a specific power mode among the plurality of power modes, calculated by the second calculator 122, is greater than a preset maximum torque amount of the specific power mode, the first determiner 123 excludes the specific power mode from among the first candidate power modes.

Referring to FIG. 5, the calculated torque amount of the first power mode PwrMod_1, greater than the preset maximum torque amount of the first power mode PwrMod_1, may be excluded from among the first candidate power modes. This is because, when the operator changes the power mode of the excavator from the currently-operating mode, i.e. the third power mode PwrMod_3, to the first power mode PwrMod_1, the same amount of power as that of the third power mode PwrMod_3 cannot be generated. When the power mode of the excavator is changed from the currently-operating third power mode PwrMod_3 to the first power mode PwrMod_1, fuel consumption is lowered, with the compromise of operating speed. This may consequently lower workability, dissatisfying the operator.

FIG. 6 illustrates a fuel map different from the fuel map of FIG. 5. Since the fuel map represents unique characteristics of the engine 40, a variety of power modes may be recommended depending on the conditions of the excavator.

The minimum recommended power mode calculator 130 calculates minimum recommended power modes according to flow rates of working fluid. The minimum recommended power mode calculator 130 also selects second candidate power modes from among the first candidate power modes, based on the calculated minimum recommended power modes. Specifically, the minimum recommended power mode calculator 130 selects power modes from among the first candidate power modes, having higher engine angular velocity than the minimum recommended power modes, as the second candidate power modes.

Due to the above-described minimum recommended power mode calculator 130, even in the case in which the operator changes the currently-operating power mode, e.g. the third power mode PwrMod_3, to a lower power mode, working fluid having a flow rate capable of maintaining the current operating speed to a specific extent can be supplied to the hydraulic system 30.

Describing in more detail with reference to FIG. 7, first, Tm indicates a period of time for which flow rates of working fluid of the power modes are monitored. T1 indicates a cumulative time for which a required flow rate Qdmd is greater than a maximum flow rate Qmax@PwrMod_1 of the first power mode PwrMod_1. T2 indicates a cumulative time for which the required flow rate Qdmd is greater than a maximum flow rate Qmax@PwrMod_2 of the second power mode PwrMod_2. The required flow rate Qdmd is controlled by the controller 100 so as not to be greater than a maximum flow rate Qmax@PwrMod_3 of the third power mode PwrMod_3.

In this condition, when a value T2/Tm is less than a minimum recommended power mode set value, the second power mode PwrMod_2 can be selected as a second candidate power mode. In contrast, when the value T1/Tm is greater than the minimum recommended power mode set value, the first power mode PwrMod_1 cannot be selected as a second candidate power mode. The minimum recommended power mode set value is a tuning parameter that does not significantly lower performance.

For example, a case in which T2/Tm is 10%, T1/Tm is 70%, and the minimum recommended power mode set value is 20% is taken. In this condition, when the operator changes the currently-operating third power mode PwrMod_3 to the second power mode PwrMod_2, 90% of the current operating speed can be satisfied. In contrast, if the operator changes the currently-operating third power mode PwrMod_3 to the first power mode PwrMod_1, 30% of the current operating speed can be satisfied.

Since the minimum recommended power mode set value without a significant effect on operating speed is set to be 20% according to the exemplary embodiment, the first power mode PwrMod_1 exceeding this value cannot be selected as a second candidate power mode, as in the selection of first candidate power modes.

According to the exemplary embodiment, the first power mode PwrMod_1 is excluded from among the candidate power modes by the torque calculator 120 and the minimum recommended power mode calculator 130, and the second power mode PwrMod_2, the third power mode PwrMod_3, and the fourth power mode PwrMod_4 remain as the second candidate power modes.

The fuel consumption calculator 140 calculates amounts of fuel consumption of the second candidate power modes. As illustrated in FIG. 4, the fuel consumption calculator 140 may include a third calculator 141 and a second determiner 142.

The third calculator 141 calculates amounts of fuel consumption of the second candidate power modes, i.e. the second power mode PwrMod_2, the third power mode PwrMod_3, and the fourth power mode PwrMod_4, using fuel consumption data including torque Tq and angular velocity ω.

The second determiner 142 selects one power mode from among the second candidate power modes, indicating lowest fuel consumption during the monitoring period, as a final recommendation power mode, based on the amounts of fuel consumption of the second candidate power modes calculated by the third calculator 141.

Referring to FIG. 5, the second power mode PwrMod_2 indicates lower fuel consumption than the third power mode PwrMod_3 and the fourth power mode PwrMod_4. Thus, according to the exemplary embodiment, the second determiner 142 selects the second power mode PwrMod_2 as the final recommendation power mode for an efficient operation.

The above-described power mode recommendation method can recommend an efficient power mode, in particular, an optimal power mode, to the operator as long as productivity is significantly reduced. This can consequently minimize fuel wastage while satisfying the operating speed of the construction machine.

The output unit 150 transfers the second power mode PwrMod_2, i.e. the final recommendation power mode selected by the second determiner 142, to the HMI device 200.

The controller 100 according to the exemplary embodiment may further include a fuel efficiency calculator 160. The fuel efficiency calculator 160 calculates average fuel efficiencies of the plurality of power modes. After average loads of the plurality of power modes are calculated, the fuel efficiency calculator 160 may calculate average fuel efficiencies during a specific period using the calculated average loads. However, the average fuel efficiencies may be inaccurate when calculated in this manner.

To overcome this problem, according to another exemplary embodiment, the fuel efficiency calculator 160 may calculate fuel efficiencies of the plurality of power modes in real time, and based on the real-time fuel efficiencies, determine average fuel efficiencies of the plurality of power modes.

The HMI device 200 may be disposed in the cab of the excavator. The HMI device 200 displays the final recommendation power mode recommended by the controller 100, e.g. the second power mode PwrMod_2, to be visually recognizable by the operator.

The power mode recommendation system according to the exemplary embodiment may further include a power mode selecting device 300.

The power mode selecting device 300 may be disposed in the cab of the excavator together with the HMI device 200. The operator manipulates the power mode selecting device 300 to select one power mode from among the plurality of power modes. The operator ultimately determines a power mode to be applied through reference to the final recommendation power mode displayed on the HMI device 200. When a single power mode is selected by the operator, the power mode selecting device 300 connected to the controller 100 transfers the selected power mode to the controller 100.

The power mode selected by the operator may be the final recommendation power mode recommended by the controller 100. However, final selection of a power mode depends on the operator.

Hereinafter, an operation of the power mode recommendation system for a construction machine according to an exemplary embodiment will be described with reference to FIG. 8. As for the reference numerals of the components, FIGS. 1 to 4 will be referred to.

As illustrated in FIG. 8, in a first step S1, the power mode recommendation system for a construction machine according to the exemplary embodiment calculates output torque and power of the engine 40, based on a flow rate of working fluid discharged by the hydraulic pump 10, a angular velocity of the engine 40, and a pressure of working fluid.

Afterwards, in a second step S2, torque amounts capable of generating the same power as calculated in the first step S1 are calculated, according to a plurality of power modes.

In sequence, in a third step S3, when the torque amount of a specific power mode among the plurality of power modes, calculated in the second step S2, is greater than a preset maximum torque amount of the specific power mode, the specific power mode is excluded from among first candidate power modes.

Afterwards, in a fourth step S4, a minimum recommended power mode is calculated depending on the flow rate of working fluid. Here, in S4-1, a power mode having a higher flow rate of working fluid than the flow rate of working fluid of the minimum recommended power mode is selected as a candidate power mode.

In sequence, in a fifth step S5, amounts of fuel consumption of the candidate power modes are calculated using fuel consumption data S5-1 including torque Tq and angular velocity ω.

Afterwards, in a sixth step S6, one power mode among the candidate power modes, indicating lowest fuel consumption during the monitoring period, is selected as a final recommendation power mode, based on the amounts of fuel consumption of the candidate power modes.

Finally, in a seventh step S7, the selected power mode is recommended to the operator. The selected power mode may be displayed on the HMI device 200 to be visually recognizable to the operator. Then, the operator can check the displayed power mode and can ultimately select a power mode to be applied to the excavator by manipulating the power mode selecting device 300.

DESCRIPTION OF REFERENCE NUMERALS OF DRAWINGS

10: Hydraulic pump
20: Pressure sensor
30: Hydraulic system
40: Engine
100: Controller
110: Receiver
120: Torque calculator
121: First calculator
122: Second calculator
123: First determiner
130: Minimum recommended power mode calculator
140: Fuel consumption calculator
141: Third calculator
142: Second determiner
150: Output unit

160: Fuel efficiency calculator

200: HMI device

300: Power mode selecting device

The invention claimed is:

1. A power mode recommendation system for recommending a power mode from among a plurality of power modes for operation of an engine of a construction machine, the construction machine including a hydraulic system driven by working fluid supplied by a hydraulic pump, the hydraulic system including a pressure sensor for sensing pressure of working fluid, the power mode recommendation system comprising:

a controller configured to conduct an analysis of engine torque, flow rates of working fluid in use, amounts of fuel consumption of the plurality of power modes and to recommend a power mode indicating lowest fuel consumption, from among the plurality of power modes, based on the analysis; and a human-machine interface device displaying the power mode recommended by the controller to an operator, wherein the controller comprises:

a torque calculator configured to calculate torque amounts of the engine according to the plurality of power modes, and based on the calculated torque amounts, select first candidate power modes from among the plurality of power modes;

a minimum recommended power mode calculator configured to calculate minimum recommended power modes according to flow rates of working fluid, and based on the calculated minimum recommended power modes, select second candidate power modes from among the first candidate power modes; and a fuel consumption calculator configured to calculate amounts of fuel consumption of the second candidate power modes.

2. The power mode recommendation system of claim 1, wherein the torque calculator comprises:

a first calculator configured to calculate output torque and power of the engine in a current state, based on flow rates of working fluid discharged by the hydraulic pump, angular velocity of the engine, and pressure of hydraulic fluid transferred by the pressure sensor; and a second calculator configured to calculate torque amounts, capable of generating the same power as the power calculated by the first calculator, according to the plurality of power modes.

3. The power mode recommendation system of claim 2, wherein the torque calculator further comprises a first determiner, wherein, when the torque amount of a specific power mode among the plurality of power modes, calculated by the second calculator, is greater than a preset maximum torque amount of the specific power mode, the first determiner excludes the specific power mode from among the first candidate power modes.

4. The power mode recommendation system of claim 1, wherein the minimum recommended power mode calculator selects power modes from among the first candidate power modes, having higher engine angular velocity than the minimum recommended power modes, as the second candidate power modes.

5. The power mode recommendation system of claim 1, wherein the fuel consumption calculator comprises a third calculator calculating amounts of fuel consumption of the second candidate power modes using fuel consumption data including torque and angular velocity.

6. The power mode recommendation system of claim 5, wherein the fuel consumption calculator further comprises a second determiner selecting one power mode from among the second candidate power modes, indicating lowest fuel consumption during a monitoring period, as a final recommendation power mode, based on the calculated amounts of fuel consumption of the second candidate power modes.

7. The power mode recommendation system of claim 6, wherein the controller further comprises an output unit transferring the final recommendation power mode, selected by the second determiner, to the human-machine interface device.

8. The power mode recommendation system of claim 1, wherein the controller further comprises a fuel efficiency calculator calculating average fuel efficiencies of the plurality of power modes.

9. The power mode recommendation system of claim 8, wherein the fuel efficiency calculator calculates average loads of the plurality of power modes and calculates average fuel efficiencies during a specific period using the calculated average loads.

10. The power mode recommendation system of claim 8, wherein the fuel efficiency calculator calculates real-time fuel efficiencies of the plurality of power modes, and based on the real-time fuel efficiencies, determines the average fuel efficiencies of the plurality of power modes.

11. The power mode recommendation system of claim 1, further comprising a power mode selecting device connected to the controller, wherein the power mode selecting device is manipulated by the operator to select one power mode from among the plurality of power modes.

* * * * *